US009493253B2

(12) United States Patent
Omura et al.

(10) Patent No.: US 9,493,253 B2
(45) Date of Patent: Nov. 15, 2016

(54) MEDICINE DISPENSING APPARATUS

(75) Inventors: Yoshihito Omura, Tokyo (JP); Syunji Ohgaya, Tokyo (JP)

(73) Assignee: TOSHO, INC., Tokyo (JP)

( * ) Notice: Subject to any disclaimer, the term of this patent is extended or adjusted under 35 U.S.C. 154(b) by 903 days.

(21) Appl. No.: 13/582,471

(22) PCT Filed: Jun. 30, 2010

(86) PCT No.: PCT/JP2010/061189

§ 371 (c)(1),
(2), (4) Date: Sep. 4, 2012

(87) PCT Pub. No.: WO2011/108129

PCT Pub. Date: Sep. 9, 2011

(65) Prior Publication Data

US 2012/0324829 A1 Dec. 27, 2012

(30) Foreign Application Priority Data

Mar. 5, 2010 (JP) ..... 2010-049905
Mar. 5, 2010 (JP) ..... 2010-049924

(51) Int. Cl.
*B65B 5/06* (2006.01)
*B65B 1/28* (2006.01)
*B08B 5/02* (2006.01)
(Continued)

(52) U.S. Cl.
CPC . *B65B 1/28* (2013.01); *B08B 5/02* (2013.01); *B08B 9/00* (2013.01); *B65B 9/02* (2013.01); *B65B 31/00* (2013.01); *G07F 11/44* (2013.01);
(Continued)

(58) Field of Classification Search
None
See application file for complete search history.

(56) References Cited

U.S. PATENT DOCUMENTS 4,627,225 A * 12/1986 Faller ..... B65B 5/103 141/93
4,664,289 A * 5/1987 Shimizu ..... G07F 11/62 221/129

(Continued)

FOREIGN PATENT DOCUMENTS

GB 2364622 A * 1/2002 ..... A61B 1/123
JP 2004-148036 5/2004

(Continued)

OTHER PUBLICATIONS

English Translation of Chinese Office Action dated Dec. 3, 2013, 2 pages.

(Continued)

*Primary Examiner* — Robert Long
*Assistant Examiner* — Mobeen Ahmed
(74) *Attorney, Agent, or Firm* — Rankin, Hill & Clark LLP

(57) ABSTRACT

A medicine guide assembly is disposed between paired adjacent medicine feeder storage units. Each medicine guide assembly guides the medicines, which have been ejected from the medicine feeders included in the paired medicine feeder storage units, to an outlet port located downward. The medicine guide assembly includes a first divided guide member and a second divided guide member which are combined with each other when the paired medicine feeder storage units are accommodated in the housing and which are separated from each other when one of the paired medicine feeder storage units is drawn out from the housing. Further, air cleaning devices are provided so as to be operable to take in air, clean the air, and supply the cleaned air to an interior of the housing.

16 Claims, 6 Drawing Sheets

(51) Int. Cl.

| | |
|---|---|
| ***G07F 17/00*** | (2006.01) |
| ***B08B 9/00*** | (2006.01) |
| ***G07F 11/44*** | (2006.01) |
| ***B65B 31/00*** | (2006.01) |
| ***B65B 9/02*** | (2006.01) |
| *B65B 5/10* | (2006.01) |

(52) U.S. Cl.
CPC ..... *G07F 17/0092* (2013.01); *B65B 5/103* (2013.01); *B65B 2210/08* (2013.01)

(56) References Cited

U.S. PATENT DOCUMENTS

| | | | | |
|---|---|---|---|---|
| 5,314,377 | A * | 5/1994 | Pelosi, III | F24F 3/161 135/128 |
| 5,348,061 | A * | 9/1994 | Riley | G07F 17/0092 141/104 |
| 5,858,040 | A * | 1/1999 | Hansen | B65B 55/027 55/385.2 |
| 5,858,041 | A * | 1/1999 | Luetkemeyer | B01D 46/0041 55/385.2 |
| 6,050,064 | A * | 4/2000 | Yuyama | B26D 3/30 53/154 |
| 6,475,435 | B1 * | 11/2002 | Taggart | B67C 7/0033 422/28 |
| 6,660,070 | B2 * | 12/2003 | Chung | B01D 46/008 55/385.2 |
| 6,742,671 | B2 * | 6/2004 | Hebron | B65B 57/20 221/10 |
| 6,772,907 | B2 * | 8/2004 | Kim | B65B 5/103 221/131 |
| 6,805,175 | B1 * | 10/2004 | Pinkas | B65B 1/16 141/130 |
| 6,928,790 | B2 * | 8/2005 | Takahashi | B65B 5/103 221/251 |
| 7,818,947 | B2 * | 10/2010 | Kim | 53/167 |
| 2004/0112911 | A1 | 6/2004 | Kim | |
| 2006/0130446 | A1 * | 6/2006 | Herbst | B01D 46/0036 55/385.1 |
| 2007/0186514 | A1 * | 8/2007 | Vollm | B65B 5/103 53/473 |
| 2008/0196367 | A1 * | 8/2008 | Ryder | G01N 1/2226 55/385.2 |
| 2009/0311951 | A1 * | 12/2009 | Walkinshaw | B60H 3/0007 451/261 |
| 2010/0043351 | A1 * | 2/2010 | Kim | B65B 55/24 53/237 |
| 2010/0126538 | A1 | 5/2010 | Dollinger | |
| 2010/0287880 | A1 * | 11/2010 | Yasunaga | A61J 7/0084 53/64 |
| 2013/0283733 | A1 * | 10/2013 | Py | B65B 55/04 53/425 |

FOREIGN PATENT DOCUMENTS

| | | |
|---|---|---|
| JP | 2005-192702 | 7/2005 |
| JP | 2006-109860 | 4/2006 |
| JP | 2007-209600 | 8/2007 |
| WO | 2008/154948 | 12/2008 |

OTHER PUBLICATIONS

International Search Report, Date of Mailing: Aug. 10, 2010.
European Search Report dated Jul. 26, 2013, eight pages.
Australian Patent Examination Report 1 dated Oct. 1, 2015, 3 pages.

* cited by examiner

MEDICINE DISPENSING APPARATUS

TECHNICAL FIELD

The present invention relates to a medicine dispensing apparatus configured to contain various sorts of medicines and automatically dispense the medicines per dose based on inputs such as prescriptions and pharmaceutical instructions.

BACKGROUND ART

With reference to FIG. 6, the configuration of a tablet dispensing apparatus, which is a typical example conventional medicine dispensing apparatus, is described below. FIG. 6(*a*) is a perspective view showing an appearance of a conventional tablet dispensing apparatus 10 as viewed from left front. FIG. 6(*b*) schematically illustrates an internal structure of the tablet dispensing apparatus 10. FIG. 6(*c*) is a perspective view showing an appearance of the conventional tablet dispensing apparatus 10 as viewed from left front. FIG. 7 is a right side elevation view showing another example of a conventional tablet dispensing apparatus 20 which is equipped with a manual medicine dispensing device (21,22).

The tablet dispensing apparatus 10 shown in FIGS. 6(*a*) to 6(*c*) is not equipped with a manual medicine dispensing device. This kind of tablet dispensing apparatus is disclosed, for example, in Japanese Patent Application Publication No. 2005-192702 (Patent Document 1) and Japanese Patent Application Publication No. 2006-109860 (Patent Document 2). The tablet dispensing apparatus 20 shown in FIG. 7 has incorporated a manual medicine dispensing device (21,22) thereinto. This kind of tablet dispensing apparatus is disclosed, for example, in Japanese Patent Application Publication No. 2007-209600 (Patent Document 3).

The tablet dispensing apparatus 10 which is not equipped with a manual medicine dispensing device includes a plurality of medicine feeders 13, a medicine collecting assembly (14,15), a packing device 17, and a controller (control device) 18. Various sorts of medicines 1 such as pills, tablets, and capsules are contained in the medicine feeders 13 by category. The medicine collecting assembly (14,15) collects the medicines 1 ejected from the medicine feeders 13. The packing device 17 packs the medicines 1 received from the medicine collecting assembly (14,15). The controller (control device) 18, which is typically equipped with a microprocessor, outputs a control command to the medicine feeders 13 and the packing device 17. Specifically, the controller 18 gives an appropriate medicine feeder 13 a control command which causes the medicine feeder 13 containing the medicines 1 indicated in prescription or pharmaceutical instruction data to eject the required number of the medicines 1. The medicines 1 ejected from the medicine feeder 13 are collected by the medicine collecting assembly (14,15) and forwarded to a medicine entry port (an entry port for the collected medicines) 16 located downward. The controller 18 gives the packing device 17 a control command which causes the packing device 17 to pack the medicines forwarded to the medicine entry port 16 in units of dose or application. The packing device 17 fills the medicines divided per dose or application into a pocket formed between two packing paper sheets (dispensing paper) 2 and then tightly seals an opening portion of the pocket.

More specifically, the tablet dispensing apparatus 10 has a housing 10A. A medicine storage 11 is disposed in an upper space inside the housing 10A, and the packing device 17 is disposed in a lower space inside the housing 10A. The medicine collecting assembly includes medicine guide assemblies 14 and a medicine collecting assembly 15, and is disposed between the medicine storage 11 and the packing device 17 inside the housing 10A. The medicine storage 11 accommodates a plurality of medicine feeder storage units (medicine cabinets) which are individually slidable and juxtaposed or arranged side by side. Each medicine feeder storage unit 12 includes a medicine storage casing 12A and a plurality of detachable medicine feeders 13, typically several to several tens of medicine feeders 13, which are disposed vertically and horizontally inside the medicine storage casing 12A.

Each medicine feeder 13 includes a medicine cassette capable of containing and ejecting a number of medicines 1 and a base portion capable of detachably supporting the medicine cassette and performing drive operation to eject the medicines from the medicine cassette. The medicine feeder 13 is operable to eject the specified number of tablets 1 as instructed by the controller 18 and forward the ejected tablets to the medicine guide assembly 14.

A publicly known medicine guide assembly 14 includes a conduit pipe such as a duct vertically or longitudinally disposed and a plurality of extension pipes communicating with respective outlets of the medicine feeders. The medicine guide assembly 14 is provided for each medicine feeder storage unit 12, and can be drawn out from the housing 10A together with the corresponding medicine feeder storage unit 12. For simplified illustration, FIG. 6(*b*) illustrates the tablet dispensing apparatus as if a common medicine guide assembly 14 exists for two medicine feeder storage units 12, and FIG. 6(*c*) omits the illustration of the medicine guide assemblies 14.

Each medicine feeder storage unit 12 is configured to horizontally slide toward the front of the housing 10A. Thus, the medicine guide assembly 14 and the medicine feeders can be drawn out from the housing 10A together with the medicine feeder casing 12A.

The medicine collecting assembly 15 is formed of a relatively large hopper-like member or an infundibulum-like member. The medicine collecting assembly 15 is incorporated in a space below the medicine storage 11 of the housing 10A. It is located above the packing device 17 in that space. An upper opening of the medicine collecting assembly 15 is opened widely enough to face respective ends of all the medicine guide assemblies 14. A lower opening of the medicine collecting member 15 is narrowed down toward the medicine entry port 16. As a result, the medicines 1 guided by any of the medicine guide assemblies 14 are gathered toward the lower opening of the medicine collecting assembly 15 and then are forwarded to the packing device 17. Thus, the medicine collecting assembly 15 works as a common guide path to the packing device 17 for all the medicine guide assemblies 14.

Pharmaceutical indications based on a prescription of dosage and administration or the like are entered by using an operation panel 19 or an appropriate input device or prescription ordering system, not illustrated. The tablet dispensing apparatus 10 ejects medicines 1 from one or more medicine feeders 13 as indicated by commands from the controller 18 upon receipt of the entered pharmaceutical indications. The ejected medicines 1 drop into the medicine collecting assembly 15 via the medicine guide assemblies 14. Then, the medicines 1 are gathered and taken out of an exit port located downward, and are entered into the medicine entry port 16 of the packing device 17. Thus, the medicines 1 pass through such medicine collecting path and are separately packed per dose in two packing paper sheets 2 by the packing device. The packing device 17 feeds two sheets form the packing paper roll in a predetermined length, and thermally seals a part of the two packing paper sheets to form a medicine storage pocket. The packing device 17 places the medicines 1 into the medicine storage pocket and thermally seals an opening of the pocket to dispense the medicines per dose. In this manner, the medicines are automatically dispensed. Specifically, the medicines 1 are ejected from appropriate medicine feeders 13 and forwarded to the packing device 17 via the medicine collecting assembly (14, 15) individually one by one or collectively in a bulk.

FIG. 7 schematically illustrates a configuration of a tablet dispensing apparatus 20 equipped with a manual medicine dispensing device as disclosed in Japanese Patent Application Publication No. 2007-209600 (Patent Document 3). The tablet dispensing apparatus 20 has incorporated the manual medicine dispensing device (21, 22) therein. The manual medicine dispensing device (21, 22) is, for example, constituted from a cassette preliminary dispenser 21 and a conveyor portion 22. The preliminary dispenser 21 has formed a number of partitions in length and width directions thereof or a number of partitions are formed crisscrossing the preliminary dispenser 21. The top or upper end of each partition is opened to receive medicines and the bottom or lower face thereof is formed of an openable shutter or the like to eject the medicines. The preliminary dispenser 21 is drawable from the housing of the tablet dispensing apparatus 20 for manual medicine dispensation to each partition. The preliminary dispenser is manually operated for medicine dispensation, but the conveyor portion 22 is operable to automatically eject the medicines. Specifically, the conveyor portion 22 is located below the manual dispenser 21 inside the housing of the tablet dispensing apparatus 20 when the manual dispenser 21 is pushed into the housing. The conveyor portion 22 receives the medicines ejected from the partition, and forwards the medicines for one partition to the packing device 17 via the medicine collecting assembly 15.

In conventional medicine dispensing apparatuses, it is sometimes required to remove and prevent contamination due to scattered or adhered medicines. Some of the conventional medicine dispensing apparatuses incorporate a dust collector or dust vacuum cleaner in a necessary location. Furnishing of such dust collector or dust vacuum cleaner is common to powder medicine dispensing apparatuses. As disclosed in Japanese Patent Application Publication No. 2004-148036 (Patent Document 4), some tablet dispensing apparatuses have a built-in tablet cutter.

PRIOR ART DOCUMENTS

Patent Documents

Patent Document 1: Japanese Patent Application Publication No. 2005-192702

Patent Document 2: Japanese Patent Application Publication No. 2006-109860

Patent Document 3: Japanese Patent Application Publication No. 2007-209600

Patent Document 4: Japanese Patent Application Publication No. 2004-148036

SUMMARY OF INVENTION

Technical Problem

In such conventional medicine dispensing apparatus, the medicine guide assembly 14 is incorporated into each of the medicine feeder storage unit 12. When cleaning the medicine guide assembly 14, it is necessary to draw out the medicine feeder storage unit 12 from the medicine storage 11 or the housing to expose the upper and lower ends of the medicine guide assembly 14. Then, a cleaning tool is inserted into an inner space of the medicine guide assembly 14 from the upper and lower openings of the medicine guide assembly 14. Cleaning is performed by wiping the inner wall surface of the medicine guide assembly 14 that defines a path along which the medicines drop. Such cleaning, however, forces a cleaning worker to take unnatural posture, thereby imposing physical strain on the worker's body. Further, the workability is bad and inefficient.

Conventionally, if it is required to dispense medicines in a clean positive pressure environment, medicine dispensation is manually performed in a clean room or using a clean bench. Automated medicine dispensation using the above-mentioned medicine dispensing apparatus has not been implemented in a positive pressure environment. However, there are strong demands for automated dispensation of medicines which are vulnerable to contamination or likely to cause contamination. Even medicines which are relatively resistant against contamination or relatively unlikely to cause contamination eventually reach the allowable limit of contamination during repeated dispensation over a long period of time. It is significant to add a contamination preventing function to the medicine dispensing apparatus or reinforce such function in viewpoint of enhanced sorts of automatically dispensable medicines and reduced cleaning and maintenance frequency. In viewpoint of costs and workability, however, it is demanded to implement a desired function by reforming the existing configurations with minor changes.

An object of the present invention is to provide a medicine dispensing apparatus which is easily cleaned and withstands contamination.

Another object of the present invention is to provide a medicine dispensing apparatus including a medicine guide assembly of which the inner surface can readily be cleaned.

A further object of the present invention is to provide a medicine dispensing apparatus of which a medicine path is not readily contaminated.

Solution to Problem

A medicine dispensing apparatus of the present invention includes, as basic elements, a housing, a plurality of medicine feeder storage units disposed inside the housing, one or more medicine guide assemblies, a medicine collecting assembly, and a packing device. The medicine feeder storage units each include a plurality of medicine feeders operable to contain medicines and sequentially eject the medicines, and a medicine feeder casing capable of accommodating the medicine feeders. The medicine feeder storage units are juxtaposed inside the housing such that the storage units can individually be drawn out from the housing. The housing is configured at least to allow the medicine feeder storage units to be individually drawn out from the housing.

The one or more medicine guide assemblies are each disposed between paired adjacent medicine feeder storage units among the plurality of medicine feeder storage units. The medicine guide assemblies are each configured to guide the medicines, which have been ejected from the medicine feeders included in the paired medicine feeder storage units, to an outlet port located downward. The medicine guide assemblies may each include a first divided guide member and a second divided guide member. The first and second guided members are combined with each other when the paired medicine feeder storage units are accommodated in the housing, and are separated from each other when one of the paired medicine feeder storage units is drawn out from the housing. In this configuration, the first divided guide member is fixed to the medicine feeder casing of one of the paired medicine feeder storage units, and the second divided guide member is fixed to the medicine feeder casing of the other medicine feeder storage unit. With this configuration, namely, if the medicine guide assembly formed of the first and second divided guide members is provided with respect to a pair of medicine feeder storage units, it may be possible to reduce the number of the medicine guide assemblies to be provided with respect to the number of the medicine feeder storage units. Thus, the medicine dispensing apparatus maybe downsized compared with conventional apparatuses. In this configuration, one medicine feeder storage unit is drawn out from the housing with the interiors of the first and second divided guide members being exposed. In this situation, the medicine guide assembly may be cleaned by individually cleaning the interiors of the first and second divided members. Consequently, the workload of the cleaning worker may significantly be reduced. Further, the structure of the medicine guide assembly formed of the first and second divided guide members is simple, thereby manufacturing the medicine guide assembly easily and at low cost.

The first and second divided guide members may arbitrarily be configured, provided that they have the above-mentioned technical features. For example, the first divided guide member may be shaped like a plate, having formed a plurality of through holes therein such that the medicines ejected from the medicine feeders included in the one medicine feeder storage unit pass through the through holes of the first divided guide member. In this case, the second divided guide member may include a plate-like portion having formed a plurality of through holes therein such that the medicines ejected from the medicine feeders included in the other medicine feeder storage unit pass through the through holes of the plate-like portion, the plate-like portion having a first edge portion located distally in a draw-out direction of the medicine feeder storage units and a second edge portion located proximately and opposite to the first edge portion in the draw-out direction; a first side wall portion extending along the first edge portion of the plate-like portion and away from the plate-like portion; and a second side wall portion extending along the second edge portion of the plate-like portion and away from the plate-like portion. In such configuration of the first and second divided members, since the shape of the first divided guide member is simple, the cost of the medicine guide assembly can furthermore be reduced.

The first and second divided guide members may of course be symmetrically shaped with respect to a parting plane thereof. If the first and second divided guide members are symmetric in shape, it is sufficient to prepare only the first divide guide member, thereby reducing the sorts of parts and manufacturing the medicine guide assembly at furthermore lower cost.

The medicine collecting assembly is disposed downward of the medicine feeder storage units and configured to collect the medicines ejected from the one or more medicine guide assemblies. The packing device is disposed downward of the medicine collecting assembly and operable to separately pack the collected medicines ejected from the medicine collecting assemblies.

In addition, the medicine dispensing apparatus may include an air cleaning device. The air cleaning device is operable to take in air from outside of the housing, clean the air, and supply the cleaned air to an interior of the housing. In this case, a flow path for cleaned air is provided to deliver at least a part of the cleaned air into the medicine guide assemblies such that the cleaned air flows downward inside the medicine guide assemblies. If such flow path for cleaned air is provided, the cleaned air delivered into each medicine guide assembly from the top of the assembly flows downward from top to bottom along the medicine path and further flows into the medicine collecting assembly. The flow of cleaned air may clean, to some extent, the interiors of the medicine guide assemblies and the medicine collecting assembly. Thus, the cleaning cycle of the interiors of the medicine guide assemblies can be extended compared with the conventional cleaning cycle. The cleaned air flowing through the medicine guide assemblies works to accelerate the falling speed of the medicines, thereby facilitating the medicine dispensing cycle.

The decelerating cleaned air, which has passed through the medicine guide assemblies and the medicine collecting assembly, enters into the packing device together with the medicines. The cleaned air is not sufficient to clean the packing device. Preferably, a branch flow path for cleaned air is provided. The branch flow path is configured to branch the cleaned air supplied from the air cleaning device and deliver the branched cleaned air directly into the packing device such that the branched cleaned air does not pass through the flow path for cleaned air. With the branch flow path for cleaned air, the packing device may positively be cleaned by the cleaned air. As a result, it is possible to obtain a medicine dispensing apparatus in which the medicine paths are not readily contaminated. In addition, the workload of the cleaning worker may be alleviated.

The installation location of the air cleaning device is arbitrary if the filter performance is high. Preferably, however, the air cleaning device is located upward of the medicine feeder storage units. In this configuration, the air cleaning device takes in external air at locations distant above the floor. Thus, relatively clean air is taken into the cleaning device. Further, since the distance between the air cleaning device and respective upper ends of the medicine guide assemblies is small, a simple structure is sufficient for delivering the cleaned air into the medicine guide assemblies.

Preferably, one or more air pollution sensors operable to sense pollution of the cleaned air are disposed inside the housing. With the air pollution sensors, it is possible to sense the air pollution due to some cause inside the housing, and early resolve the air pollution.

The one or more air pollution sensors may be disposed at arbitrary locations in air paths through which the cleaned air supplied from the air cleaning device passes. Preferably, the one or more air pollution sensors are disposed in at least one location selected from inside or outside of the flow path for cleaned air, inside or at an outlet port of the branch flow path for cleaned air, inside or in the vicinity of the medicine collecting assembly, and inside or in the vicinity of the packing device. If the sensors are disposed at these locations, it is possible to timely and certainly know from the detected air pollution that cleaning should early be performed, the air cleaning device is in an abnormal condition, etc.

It is arbitrary how to utilize the detection by the air pollution sensor. For example, the air cleaning device may have a controller operable to vary the amount of air which the air cleaning device supplies, according to the level of pollution of the cleaned air sensed by the air pollution sensor. With this, the cause of pollution of the cleaned air may be eliminated by increasing the amount of air. The increased amount of air may be reduced after the cause has been eliminated.

Further, an alarm signal generator maybe provided. The alarm signal generator is operable to generate an alarm signal when the pollution of the cleaned air sensed by the air pollution sensor reaches or exceeds a predetermined level. For example, an alarm signal is generated to produce sound or emit light in order to warn the worker that cleaning should early be performed. Alternatively, an alarm signal is generated to stop the medicine dispensing apparatus.

When the medicine guide assembly formed of the first and second divided guide members is employed in the medicine dispensing apparatus of the present invention, the air cleaning device is not necessarily provided. When the air cleaning device is provided in the medicine dispensing apparatus of the present invention, the medicine guide assembly formed of the first and second divided guide members is not necessarily employed. Cleaning may be performed by employing a configuration including an air cleaning device in a medicine dispensing apparatus which employs a conventional medicine guide assembly.

BRIEF DESCRIPTION OF DRAWINGS

FIG. 1(*b*) is a front view thereof. FIG. 1(*c*) is a right side elevation view thereof.

FIG. 2(*b*) is a plan view thereof.

FIG. 3(*b*) is a perspective view of a second divided guide member as viewed from left above.

FIG. 6(*b*) schematically illustrates an interior of the conventional tablet dispensing apparatus. FIG. 6(*c*) is a perspective view showing an appearance of the conventional tablet dispensing apparatus as view from left front.

DESCRIPTION OF EMBODIMENTS

Now embodiments of the present invention will be described below in detail.

Figure 1:
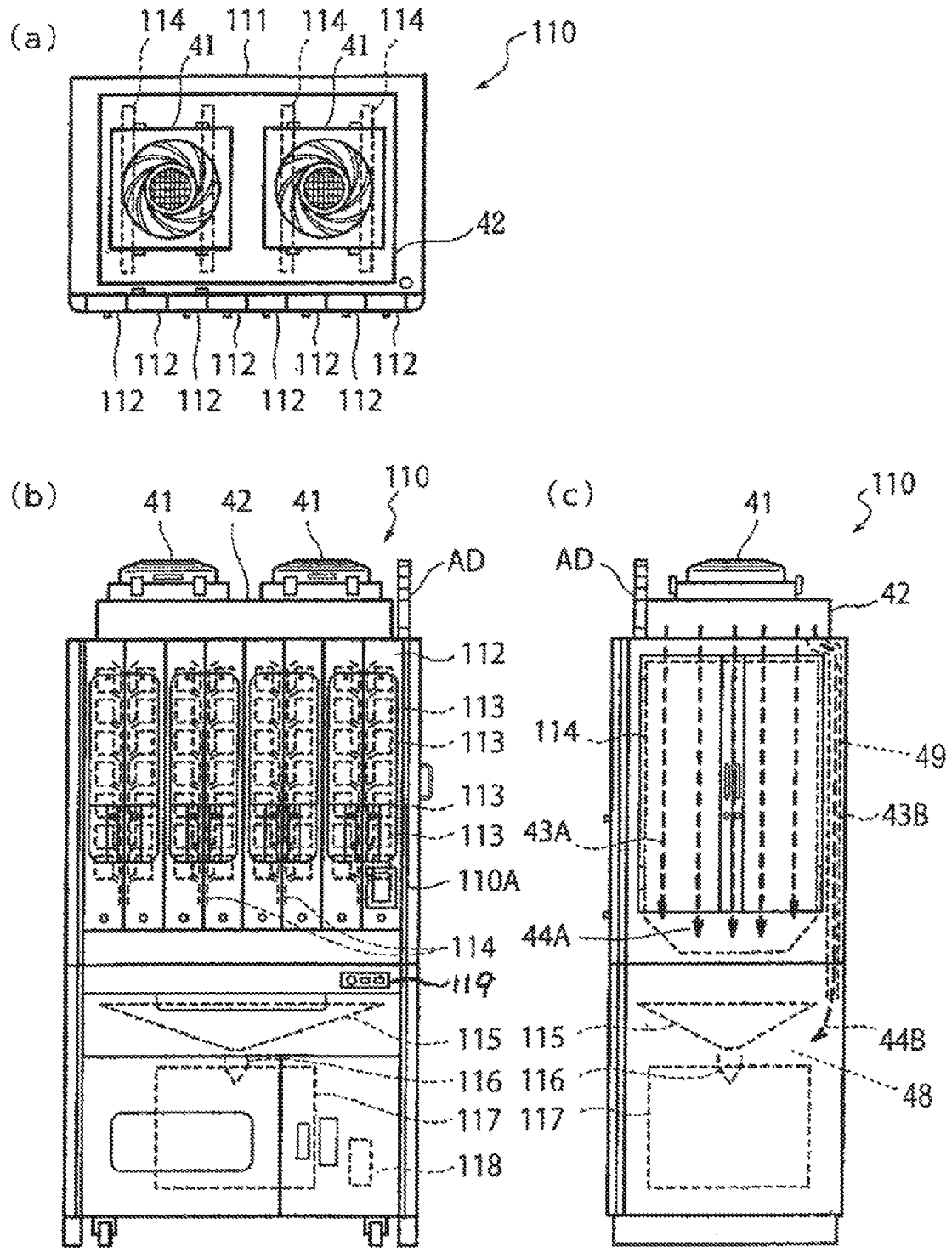
FIG. 1(*a*) illustrates an overall configuration according to a first embodiment of the present invention as applied to a tablet dispensing apparatus.
Figure 2:
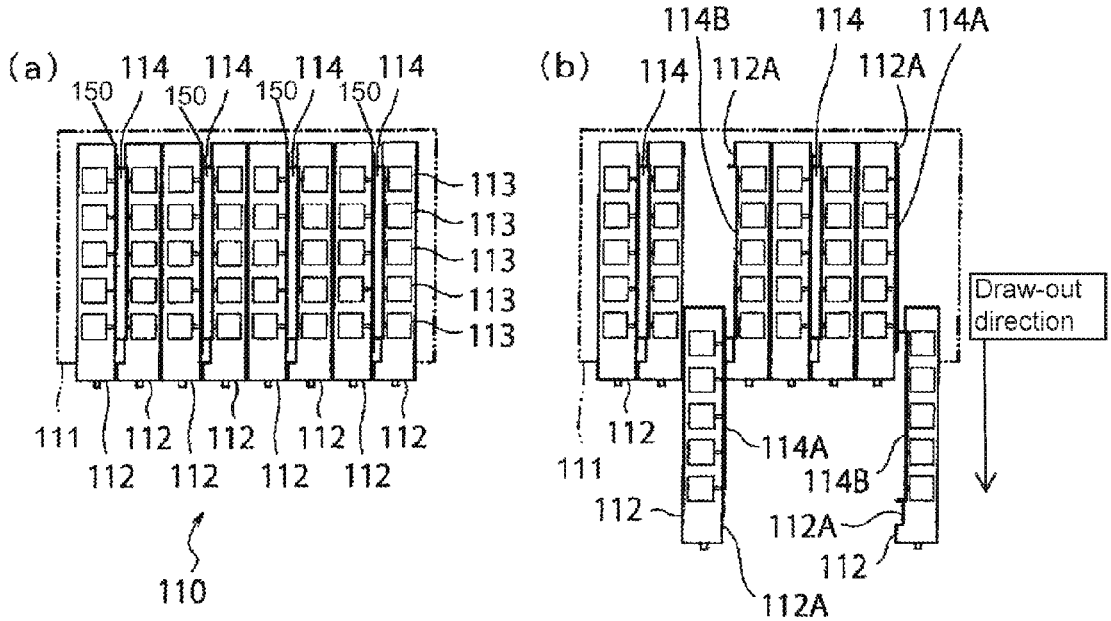
FIG. 2(*a*) illustrates a major part of the tablet dispensing apparatus of FIG. 1 according to the first embodiment.
Figure 3:
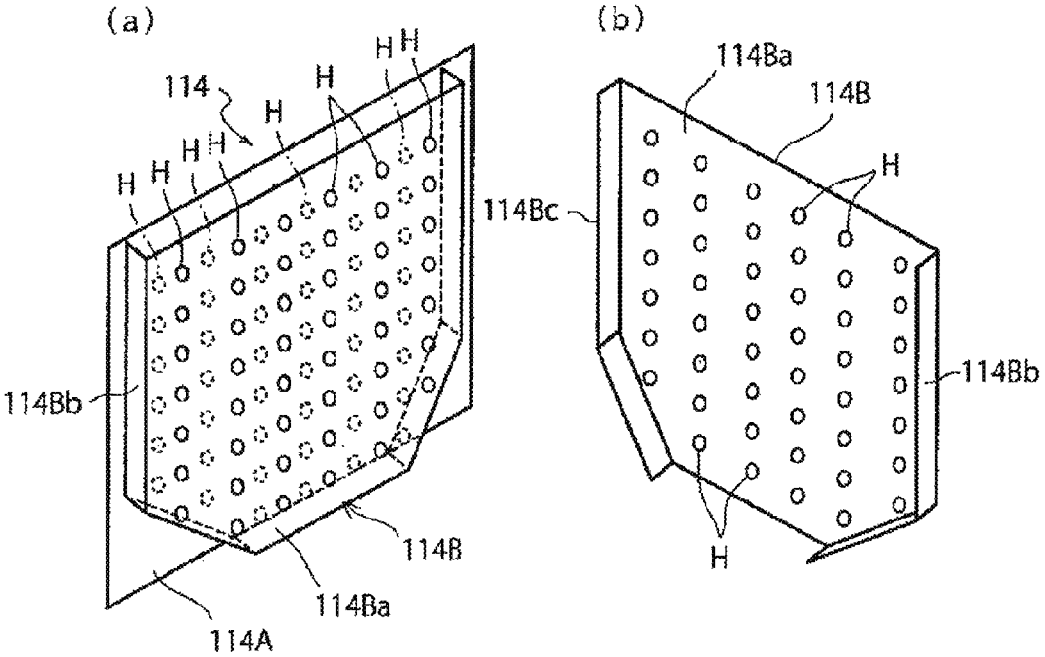
FIG. 3(*a*) is a perspective view of a medicine guide assembly as viewed from right above.
Figure 4:
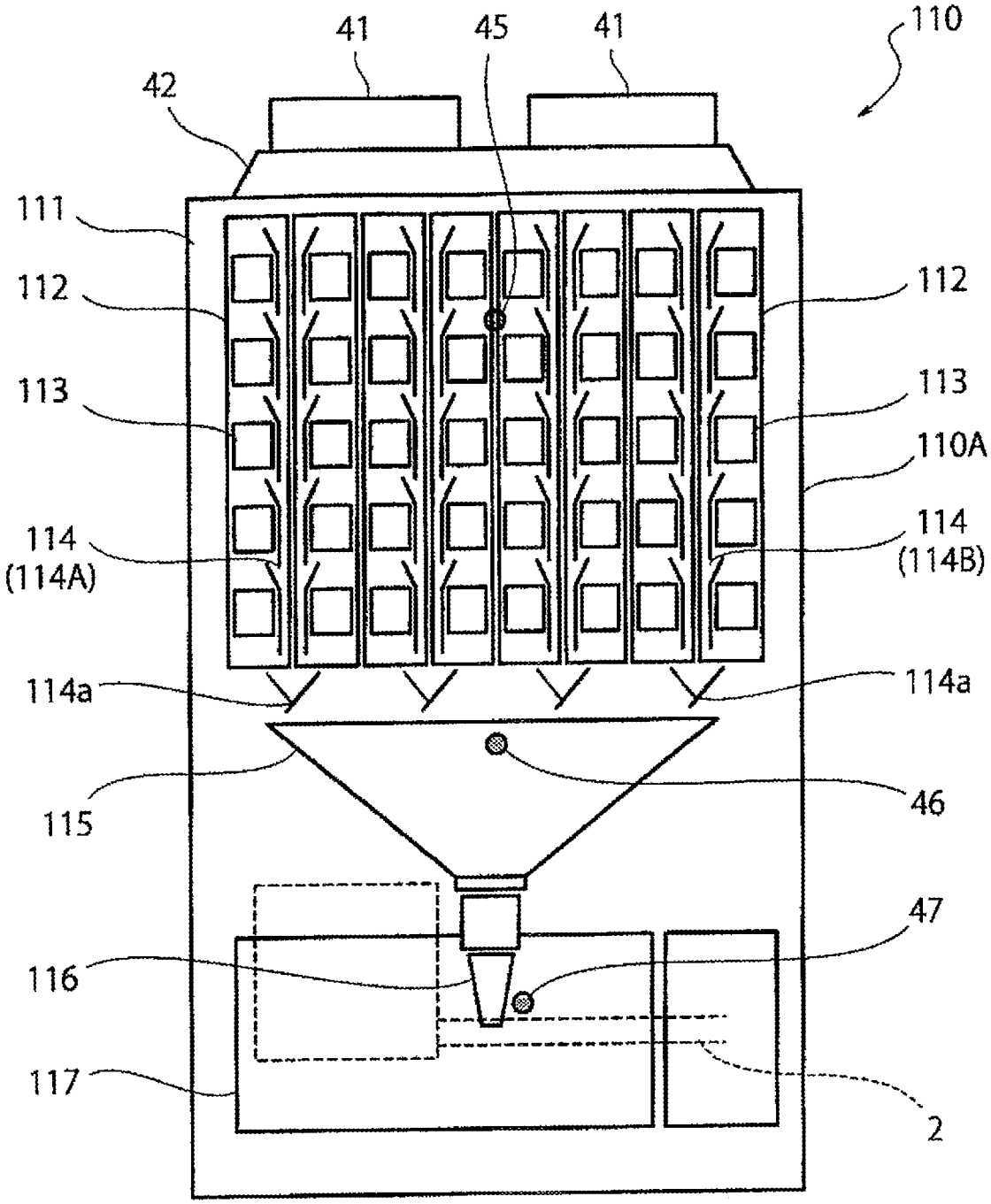
FIG. 4 schematically illustrates an interior of the tablet dispensing apparatus of the present invention.
Figure 6:
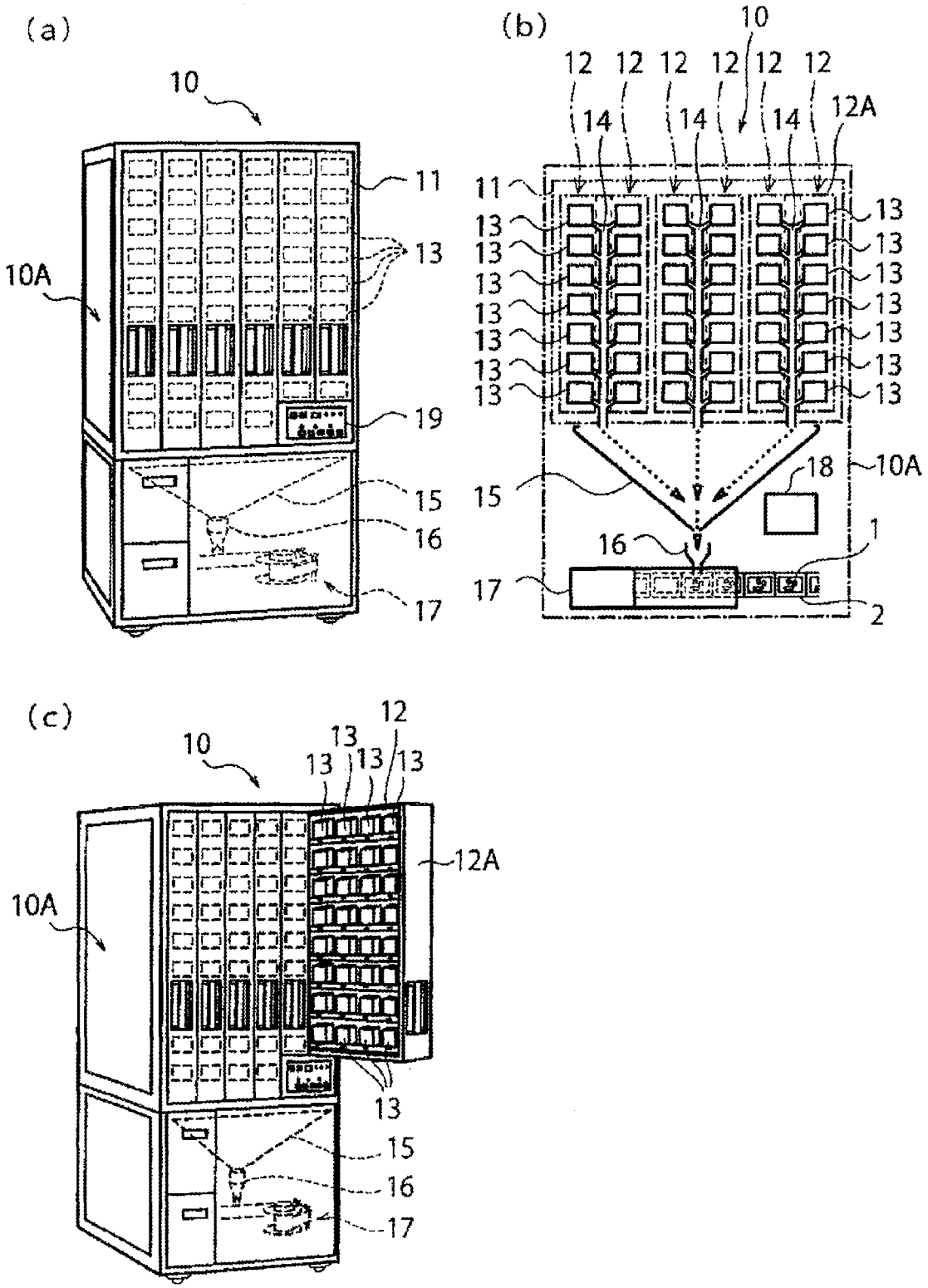
FIG. 6(*a*) is a perspective view showing an appearance of a conventional tablet dispensing apparatus as view from left front.
Figure 7:
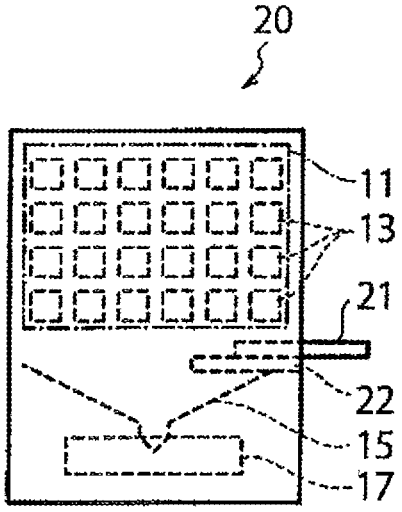
FIG. 7 is a left side elevation view of a conventional tablet dispensing apparatus equipped with a manual medicine dispensing device.

Parts of a medicine dispensing apparatus of FIGS. 1 to 4 are allocated reference numerals defined by adding 100 to reference numerals allocated to counterparts of a conventional medicine dispensing apparatus of FIG. 6. A medicine dispensing apparatus according to a first embodiment of the present invention is a tablet dispensing apparatus 110 which is a typical example. FIGS. 1(*a*), 1(*b*), and 1(*c*) are a plan view, a front view, and a right side elevation view of the tablet dispensing apparatus 110 of the first embodiment, respectively. FIG. 2(*a*) is a plan view primarily showing a plurality of medicine guide assemblies 114 wherein all the medicine feeder storage units 112 are pushed in a medicine storage 111 indicated with dotted lines. FIG. 2(*b*) is a plan view primarily showing the medicine guide assemblies 114 wherein some of the medicine feeder storage units 112 are drawn out from the medicine storage 111. FIG. 3(*a*) is a perspective view of one medicine guide assembly 114 formed of first and second divided guide members 114A and 114B as viewed from right above. FIG. 3(*b*) is a perspective view of the second divided guide member 114B as viewed from left above. FIG. 4 schematically illustrates an internal configuration of the table dispensing apparatus 110.

The tablet dispensing apparatus 110 includes eight medicine feeder storage units 112, four medicine guide assemblies 114, a medicine collecting assembly 115, a packing device 117, a controller 118, and an operation panel 119. The medicine feeder storage units 112 each receive a plurality of medicine feeders 113 in a medicine feeder casing 112A. The medicine feeders 113 each contain various sorts of tablets such as pills and capsules by category. The controller 118 outputs control commands to the medicine feeders 113 and the packing device 117.

Eight medicine feeder storage units 112 are juxtaposed or arranged side by side in the medicine storage 111 so as to be individually slidable.

In this embodiment, the four medicine guide assemblies 114 are each disposed between paired adjacent medicine feeder storage units 112, 112 among the eight medicine feeder storage units 112. Each medicine guide assembly 114 guides the medicines, which have been ejected from the medicine feeders 113 included in the paired medicine feeder storage units 112, 112, to an outlet port located downward. The medicine guide assemblies 114 each include a first divided guide member 114A and a second divided guide member 114B. The first and second guide members 114A, 114B are combined with each other when the paired medicine feeder storage units 112, 112 are accommodated in the housing 110A, and are separated from each other when one of the paired medicine feeder storage units 112, 112 is drawn out from the housing 110A. The housing 110A has a door operable to open when drawing out the medicine feeder storage units 112 from the housing 110A. The first divided guide member 114A is fixed to the medicine feeder casing 112A of one of the paired medicine feeder storage units 112, 112 and the second divided guide member 114B is fixed to the medicine feeder casing 112A of the other medicine feeder storage unit 112. The first and second divided guide members 114A, 1148 may of course be symmetrically shaped with respect to a parting plane 150 thereof. If the first and second divided guide members 114A, 114B are symmetric in shape, it is sufficient to prepare only the first divide guide member, thereby reducing the sorts of parts and manufacturing the medicine guide assembly at furthermore lower cost.

As shown in FIG. 3(*a*), the first divided guide member 114A is shaped like a plate, having formed a plurality of through holes H therein such that the medicines ejected from respective exits of the medicine feeders 113 included in the one medicine feeder storage unit 112 pass through the through holes H of the first divided guide member 114A. The second divided guide member 114B includes a plate-like portion 114Ba having formed a plurality of through holes H therein such that the medicines ejected from the medicine feeders 113 included in the other medicine feeder storage unit 112 pass through the through holes H of the plate-like portion 114Ba. The plate-like portion has a first edge portion located distally in a draw-out direction of the medicine feeder storage units 112 and a second edge portion located proximately and opposite to the first edge portion in the draw-out direction. The second divided guide member 114B also includes a first side wall portion 114Bb extending along the first edge portion of the plate-like portion 114Ba and away from the plate-like portion 114Ba, and a second side wall portion 114Bc extending along the second edge portion of the plate-like portion 114Ba and away from the plate-like portion 114Ba. To increase alignment tolerance, the first divided guide member 114A is slightly wider than the plate-like portion 114Ba of the second divided guide member 114B. Each medicine guide assembly formed of the first and second divided guide members 114A and 114B facing each other has open upper and lower ends. One medicine guide assembly 114 is disposed between paired adjacent medicine feeder storage units 112, 112 and is configured to guide the medicines, which have been ejected from the medicine feeders 113 mounted in the paired adjacent medicine feeder storage units 112, 112, to allow all the medicines to drop down. Further, each medicine guide assembly 114 becomes narrower downward, thereby narrowing an opening at the lower end thereof . This, in turn, narrows an upper opening of the medicine collecting assembly 115 in front-to-back width.

If one medicine guide assembly 114 formed of the first and second divided guide members 114A and 114B is provided with respect to a pair of medicine feeder storage units, the number of the medicine guide assemblies can be halved relative to the number of the medicine feeder storage units 112. Thus, the tablet dispensing apparatus of the present invention can be downsized compared with conventional apparatuses. With such configuration, the medicine feeder storage unit 112 is drawn out from the housing 110A with the interiors of the first and second divided guide members 114A and 114B being exposed. The medicine guide assembly 114 can be cleaned by individually cleaning the interiors of the first and second divided guide members 114A and 114B, thereby avoiding excessive workload imposed on the cleaning worker.

The medicine collecting assembly 115 is disposed downward of the eight medicine feeder storage units 112 inside the housing 110A, and is configured to collect the medicines ejected from the four medicine guide assemblies 114. The medicine collecting assembly 115 is formed of a relatively large hopper-like member or an infundibulum-like member. An upper opening of the medicine collecting assembly 115 is opened widely enough to face respective ends of all the medicine guide assemblies 114. A lower opening of the medicine collecting member 115 is narrowed down toward a medicine entry port 116 of the packing device 117. As a result, the medicines guided by any of the medicine guide assemblies 114 are gathered toward the lower opening of the medicine collecting assembly 115 and then fed into the packing device 117. The packing device 117 works in the same manner as conventional packing devices.

As shown in FIG. 1, the tablet dispensing apparatus 110 of the first embodiment includes two air cleaning devices 41, 41 at a top panel portion of the housing 110A. The air cleaning devices are each operable to take in air from outside of the housing 110A, clean the air, and supply the cleaned air to an interior of the housing 110A. An air supply chamber 42 is provided below the top panel portion of the housing 110A between the air cleaning devices 41 and the medicine storage 111. The air supply chamber 42 is configured to temporarily pool cleaned air discharged from the air cleaning devices 41. The air cleaning device is typically a commercially available clean air supply unit formed of combination of a fan capable of blowing an appropriate amount of air and cleaning members such as HEPA or ULPA filters. The air cleaning devices 41 used in this embodiment are configured to take in air from an upper space above the housing 110A, clean the air, for example, up to a level of class 1000, and deliver the cleaned air into the air supply chamber 42 located right beneath. The air supply chamber 42 may be formed of a simple box structure, provided that it is capable of temporarily pooling the cleaned air and alleviating unbalanced air current and atmospheric pressure.

The four medicine guide assemblies 114 communicate with the air supply chamber 42. The cleaned air supplied from the air cleaning devices 41, 41 into the housing 110A flows through the medicine guide assemblies 114 downward or from top to bottom. The internal space of each medicine guide assembly 114 defines a flow path 43A for cleaned air to allow at least a part (44A) of the cleaned air 44 to flow therealong. If such flow path 43A is provided, the cleaned air 44A delivered from the top of each medicine guide assembly 114 flows downward along a medicine falling path, and further flows into the medicine collecting assembly 115. As a result, the interiors of the medicine guide assemblies 114 and the medicine collecting assembly 115 may be cleaned to some extent by the flowing cleaned air 44A.

The decelerating cleaned air 44A, which has passed through the medicine guide assemblies 114 and the medicine collecting assembly 115, enters into the packing device 117 together with the medicines. At this point, however, the cleaned air 44A is not sufficient to clean an interior of the packing device 117. Then, in this embodiment, a branch flow path 43B for cleaned air is provided. The branch flow path 43B is configured to branch the cleaned air supplied from the air cleaning devices 41, 41 and deliver the branched cleaned air 44B directly to or in the vicinity of the packing device such that the branched cleaned air 44B does not pass through the flow path 43A for cleaned air. Specifically, as shown in FIG. 1(*c*), one or more air supply pipes 49 each formed of a upright duct are disposed in the rear of the housing 110A so as to communicate with a lower space 48 inside the housing 110A inside which the air supply chamber 42 and the packing device 117 are disposed. Each of the air supply pipes 49 forms the branch flow path 43B for cleaned air. The branch flow paths 43B allow a part 44B of the cleaned air to be guided from the air supply chamber 42 to the lower space 48 inside the housing 110A, bypassing the medicine guide assemblies 114, the medicine feeder storage units 112, and the medicine collecting assembly 115. The cleaned air 44B thus guided flows into the packing device 117 at the medicine entry port 116. Thanks to the branch flow paths 43B, the packing device 117 can also be cleaned positively by the cleaned air 44B. The branch flow paths 43B defined by the one or more air supply pipes 49 are longer than the flow path 43A, but can easily be provided since they can be formed of flexible hoses or the like.

The installation locations of the air cleaning devices 41, 41 are arbitrary if the filter performance is high. In this embodiment, the air cleaning devices 41, 41 are disposed above the medicine feeder storage units 112. In this configuration, the air cleaning devices 41, 41 take in air from an upper space distant from the floor, and the air thus taken in is relatively clean.

Preferably, one or more air pollution sensors 45 to 47 are disposed inside the housing 110A. With the air pollution sensors 45 to 47, it is possible to sense air pollution due to some cause inside the housing 110A, and early resolve the air pollution. The air pollution sensors 45 to 47 may arbitrarily be configured, provided that the sensors are capable of sensing the air pollution at respective installation locations. For example, low-priced and easy-to-use optical particle sensors may be used as the air pollution sensors.

The one or more air pollution sensors 45 to 47 may be disposed at arbitrary locations in air paths through which the cleaned air supplied from the air cleaning devices 41, 41 flows. Specifically, the air pollution sensors 45 to 47 are disposed in at least one location selected from inside or outside of the flow path 43A for cleaned air, inside or in the vicinity of an outlet port of the branch flow path 43B for cleaned air, inside or in the vicinity of the medicine collecting assembly 115, inside or in the vicinity of the packing device 117, and in the vicinity of the medicine entry port 116. In this embodiment, the air pollution sensor 45 is disposed inside the medicine storage 111 in the vicinity of the front side wall of the housing 110A. The air pollution sensor 46 is located closer to the medicine collecting assembly 115 than the packing device 117. Among the sensors, the air pollution sensor 47 is located closest to the packing device 117 and just next to the medicine entry port 116. All the sensing results of the air pollution sensors 45 to 47 are sent to the controller 118 via signal cables or the like.

It is arbitrary how the sensing results are utilized. For example, the controller 118 may be configured to vary the amount of air which the air cleaning devices 41, 41 supply, according to the level of pollution of the cleaned air sensed by the air pollution sensors 45 to 47. In this case, the controller 118 works to control the air cleaning devices 41, 41. In this embodiment, in addition to controlling medicine dispensation mentioned so far, the controller 118 also works to vary the amount of air supplied from the air cleaning devices 41, 41 based on the sensing results. If a plurality of air pollution sensors 45 to 47 are provided, the highest level of air pollution may be chosen as the sensed air pollution level from among the levels of air pollution sensed by the sensors 45 to 47. Alternatively, the sensing results of the air pollution sensors 45 to 47 may be averaged by calculating an average of the sensing results, and the calculated average may be used as the air pollution level. In this embodiment, the amount of air supplied from the air cleaning devices 41 is increased if the sensed air pollution level rises. The amount of air supplied from the air cleaning devices 41 is decreased if the air clean level rises. In such controlling manner, the cause of pollution of the cleaned air can be eliminated by increasing the amount of air supplied from the air cleaning devices 41. Afterwards, the amount of air supplied from the air cleaning devices 41 may be decreased, thereby saving energy.

Further, an alarm signal generator may be provided in the controller 118 so as to be operable to generate an alarm signal when the pollution of the cleaned air sensed by the air pollution sensors 45 to 47 reaches or exceeds a predetermined level. In this embodiment, a multi-color light emitting device (alarming means) AD is provided at the top panel of the housing 110A and is configure to emit light of different colors as indicated by an alarm signal generated by the controller 118. Thus, the color of the emitted light is changed according to the alarm signal, and the level of pollution of the cleaned air is indicated with emitting light of different colors. In addition to the emitting light, beeping or buzzer sound as well as a literal alarm or alarm in a text form on the display panel may be used to warn the worker that cleaning should early be performed. Alternatively, the alarm signal may be operable to stop the medicine dispensing apparatus.

The sensing results of the air pollution sensors 45 to 47 may directly be sent to the alarming means via signal cables or the like without intervention of the controller 118. Further, the sensing results of the air pollution sensors 45 to 47 may be classified into some levels and indicated to people working around by varying the display color or produced sound.

As shown in FIG. 4, four shutter-type temporary pools 114*a* are disposed below the respective lower ends of the four medicine guide assemblies 114. The medicines fall down through the medicine guide assemblies 114 and then are pooled in the temporary pools 114*a*. When the shutters are opened as indicated by an open command from the controller 118, the medicines pooled in the temporary pools 114*a* drop into the medicine collecting assembly 115. The temporary pools 114 work for buffering, and may prevent the medicines from jumping and scattering.

Next, how the tablet dispensing apparatus 110 of the first embodiment is used or operated will be described below. The basic usage and operations of the tablet dispensing apparatus 110 are the same as those of the conventional apparatuses except that the medicines guided by the medicine guide assemblies are temporarily received in the temporary pools 114*a* and then discharged with appropriate timing to drop into the medicine collecting assembly 115. Here, repeated descriptions are omitted. Only the differences with the conventional apparatuses, namely, how to clean the medicine guide assemblies 114 and how to operate the air cleaning means 41 to 47 disposed inside the housing will be described below.

During ordinary operation such as medicine dispensation, all the medicine feeder storage units 112 are pushed into the medicine storage 111. In this situation, the first and second divided guide members 114A and 114B of each medicine guide assembly 114 adjacently face each other and a pair of inner surfaces, namely, the respective inner surfaces of the first and second divided guide members 114A and 114B define a medicine falling path.

In this situation, when the air cleaning devices 41 are activated, air is taken in from an upper space above the tablet dispensing apparatus 110. Then, the cleaned air 44 is first delivered into the air supply chamber 42 and temporarily pooled there.

A major part of the pooled cleaned air is delivered from the air supply chamber 42 into the respective upper ends of the four medicine guide assemblies 114. Then, the cleaned air flows through the flow paths 43A for cleaned air defined inside the medicine guide assemblies 114. The remaining part of the pooled cleaned air is delivered from the air supply chamber 42 into an upper end of the branch flow path 43B for cleaned air formed of an air supply pipe. The cleaned air 44A entering into the flow paths 43A inside the medicine guide assemblies 114 flows downward or from top to bottom through the flow paths 43A which is a part of the medicine falling path. The cleaned air 44A flows out of the medicine guide assemblies 114 and flows into the medicine collecting assembly 115 which is also a part of the medicine falling path. Dust attached onto the inner wall surfaces of the medicine guide assemblies 114 and the medicine collecting assembly 115 are blown off by the flowing cleaned air. Thus, cleaning is constantly performed.

The cleaned air 44B entering into the branch flow path 43B from the air supply pipe flows out of the branch flow path 43B without being polluted, bypassing the medicine feeder storage units 112, the medicine guide assemblies 114 and the medicine collecting assembly 115. Then, the cleaned air 44B is blown onto the packing device 117. Thus, dust attached to the packing device 117 is also blown off. The wall surfaces located from the beginning to the end of the medicine falling path is constantly cleaned in this manner.

The cleaned air delivered into the housing leak out of the housing 110A through gaps for allowing the medicine feeder storage units 112 to slide out and gaps of the door. Consequently, the interior of the housing 110A is maintained at positive pressure higher than the atmosphere around the housing 110A. This may prevent dust from entering into the housing 110A.

In addition, the air pollution inside the medicine storage 111 is measured by the air pollution sensor 45, the air pollution around the medicine collecting assembly 115 is measured by the air pollution sensor 46, and the air pollution around the medicine entry port 116 of the packing device 117 is measured by the air pollution sensor 47. For example, the respective measured values or sensed values are compared with predetermined thresholds, and are classified into air pollution levels, good, caution needed, bad, or the like. The air pollution level is displayed on the display AD and beeping sound is produced. Thus, people working around the tablet dispensing apparatus 110 can easily notice the air pollution level of the tablet dispensing apparatus 110.

Further, the measured values or sensed values of the air pollution sensors 45 to 47 are averaged by the controller 118, thereby quantifying the air pollution inside the housing 110A of the tablet dispensing apparatus 110. If it is determined by the controller 118 that the air inside the housing 110A is clean, the amount of air supplied from the air cleaning devices 41 is decreased. If it is determined by the controller 118 that the air inside the housing 110A is polluted, the amount of air supplied from the air cleaning devices 41 is increased. The amount of air supplied from the air cleaning devices 41, namely, cleaned air 44A and 44B is increased only during a limited period of time so as not to badly affect the ejection, dropping, and gathering of the medicines.

When cleaning the medicine guide assemblies 114, the automated medicine dispensation is stopped and the air cleaning devices disposed inside the housing are deactivated. The first and second divided guide members 114A and 114B of each medicine guide assembly 114 are individually cleaned. More specifically, first, one of the paired adjacent medicine feeder storage units 112 is drawn out from the medicine storage 111. If the medicine feeder storage unit thus drawn out is a left unit in the pair, the first divided guide member 114A is drawn out from the housing 110A and the entire surface of the first divided guide member 114A that contacts the medicines is exposed. Then, the entire surface is wiped out for cleaning.

Next, the medicine feeder storage unit 112 which has been cleaned is pushed back into the medicine storage 111, and then the other medicine feeder storage unit 12 which is a right unit in the pair is drawn out from the medicine storage 111. This time, the second divided guide member 1148 is drawn out from the housing 110A and the entire surface of the second divided guide member 114B that contacts the medicines is exposed. Then, the entire surface is wiped out for cleaning. Then, the medicine feeder storage unit 12 which has been cleaned is pushed back into the medicine storage 11. Thus, the surfaces of the medicine guide assembly 114 that contacts falling medicines are entirely cleaned. In addition, the worker can perform cleaning, standing up as with the window cleaning.

In the first embodiment as described above, the air pollution sensors are disposed only at locations where the cleaned air is discharged, but are not disposed at locations from which the cleaned air is supplied. For example, however, the air pollution sensors may be provided in the air supply chamber 42 and the sensing results may be reflected in the control of the amount of air supplied from the air cleaning devices 41 or the alarm for air pollution.

In the first embodiment, the filter is installed only in the air cleaning devices 41. Of course, the filter may be installed in the air supply chamber 42. In this case, an ordinary fan may be used as an air cleaning device and a filter may be installed at an entry port of the air supply chamber 42 such that the fan and the air supply chamber cooperate to work as an air cleaning device.

In the first embodiment, identification and engagement of a medicine cassette and a base portion of the medicine feeder 113 are not described. As have conventionally been done, mechanical identification may be employed to determine whether or not a protrusion (convex portion) is well engaged with a recess (concave portion). Alternatively, electrical or optical identification may be employed to determine whether or not there are identification members at respective portions to be sensed. Further, a wireless tag may be attached to the medicine cassette and a wireless tag reader, which is capable of reading identification data for matching as disclosed in Patent Document 4, may be attached to the base portion of the medicine feeder 113. The wireless tag is alternatively called as a radio frequency identification (RFID) tag, an electronic tag, a data carrier, or a data storage medium. The wireless tag is equipped with an IC having mounted memory and a control circuit thereon as well as an antenna and a communication circuit for local communication. The wireless tag receives a command signal from the reader by means of radio waves or alternating magnetic fields, and reads tag information stored in the memory or transmits a response to the reader according to the received command.

Figure 5:
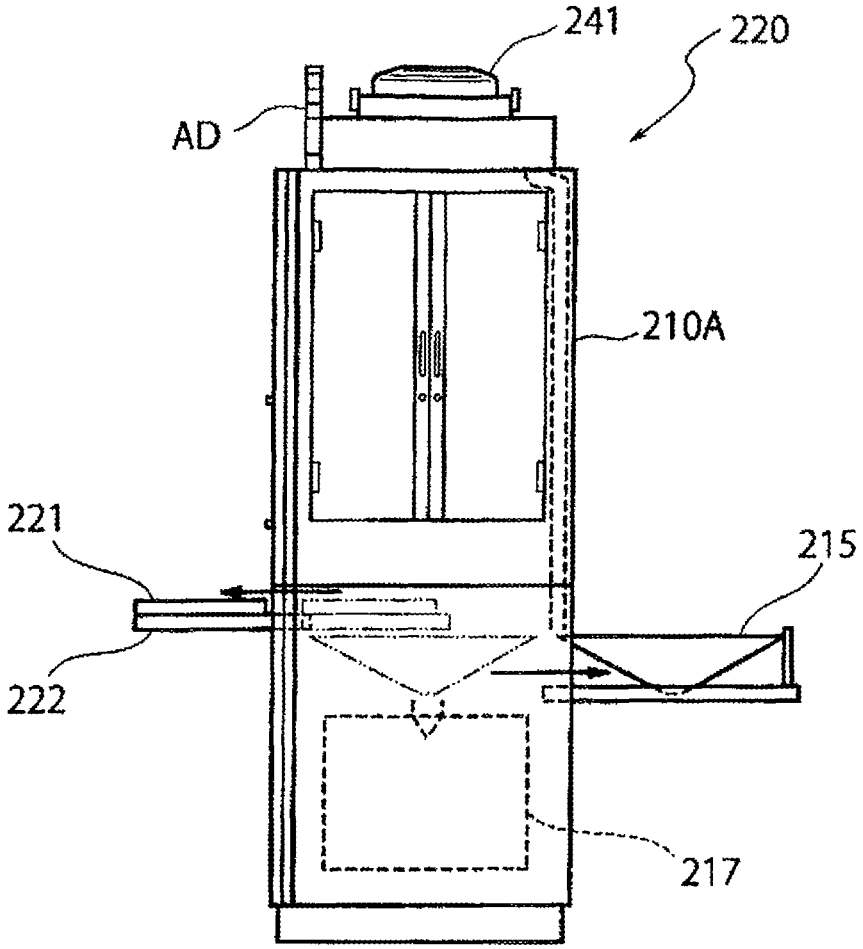
FIG. 5 is a right side elevation view of a second embodiment of the present invention as applied to a tablet dispensing apparatus equipped with a manual medicine dispensing device.

The first embodiment describes the present invention as applied to a tablet dispensing apparatus without a manual medicine dispensing device. As shown in FIG. 5, a second embodiment describes the present invention as applied to a tablet dispensing apparatus 220 equipped with a manual medicine dispensing device. In the second embodiment of FIG. 5, parts of the tablet dispensing apparatus are allocated reference numerals defined by adding 200 to reference numerals allocated to the counterparts of a conventional tablet dispensing apparatus equipped with a manual medicine dispensing apparatus. As with the first embodiment, the tablet dispensing apparatus of the second embodiment is equipped with an air cleaning device 241 on a housing 210A. Also as with the first embodiment, medicine guide assemblies each formed of first and second divided guide members are disposed inside the housing 210A. The manual medicine dispensing device 221, 222 includes a cassette preliminary dispenser 221 and a conveyor portion 222. The preliminary dispenser 221 is formed of a number of partitions arranged in length and width directions. Each partition has an open upper or top end for entry of medicines and a lower or bottom face formed of a shutter capable of ejecting medicines. The preliminary dispenser 221 can slide out from the housing of the tablet dispensing apparatus 220 such that medicines are manually dispensed into the partitions. The entry of the medicines into the preliminary dispenser is manually done, but the conveyor portion 222 is operable to automatically eject the medicines. The conveyor portion 222 receives the medicines ejected from the partitions of the preliminary dispenser 221, and forwards the medicines per partition to a packing device 217 via a medicine collecting assembly 215. The tablet dispensing apparatus 220 equipped with a manual medicine dispensing device 221, 222 is configured to operate in the same manner as the first embodiment in a condition that the manual medicine dispensing device 221, 222 is drawn out from the housing when the manual medicine dispensing device is not used. When the manual medicine dispensing device 221, 222 is used, the dispensation from the medicine feeders is stopped, but the air cleaning device 241 is in motion. Consequently, cleaned air is constantly supplied from the air cleaning device 241 to flow inside the housing 210A. Thus, cleaning by cleaned air is continued.

Either of the tablet dispensing apparatuses of the first and second embodiments is equipped with the air cleaning device 41, 241. As shown in FIGS. 1 to 3, the medicine guide assemblies 114 each formed of the first and second divided guide members may of course be used in a medicine dispensing apparatus without an air cleaning device. The cleaning system utilizing the air cleaning devices 41, 241 respectively disposed in the medicine dispensing apparatuses of the first and second embodiments may of course be used in a medicine dispensing apparatus which does not employ the medicine guide assemblies each formed of the first and second divided guide members as shown in FIGS. 1 to 3.

INDUSTRIAL APPLICABILITY

According to the present invention, since the medicine guide assemblies each formed of the first and second divided guide members are provided with respect to a pair of medicine feeder storage units, it is possible to reduce by half the number of the medicine guide assemblies to be provided with respect to the number of the medicine feeder storage units. Thus, the medicine dispensing apparatus may be downsized compared with conventional apparatuses. In this configuration, one medicine feeder storage unit is drawn out from the housing with the interiors of the first and second divided guide members being exposed. In this situation, the medicine guide assemblies may be cleaned by individually cleaning the interiors of the first and second divided members. Further, the structure of the medicine guide assembly formed of the first and second divided guide members is simple and can be separated into two, thereby manufacturing the medicine guide assembly easily and at low cost.

The air cleaning device is provided inside the housing so as to be operable to take in air from outside of the housing, clean the air, and supply the cleaned air to an interior of the housing. Further, a flow path for cleaned air is provided so as to deliver at least a part of the cleaned air into the medicine guide assemblies such that the cleaned air flows downward inside the medicine guide assemblies. The cleaned air, which has been delivered into the medicine guide assembles from the top of the assembles, flows downward from top to bottom along the medicine falling paths and further flows into the medicine collecting assembly. The flow of cleaned air may clean, to some extent, the interiors of the medicine guide assemblies and the medicine collecting assembly. Thus, the cleaning cycle of the interiors of the medicine guide assemblies can be extended more than ever. The cleaned air flowing through the medicine guide assemblies works to accelerate the falling speed of the medicines, thereby facilitating the medicine dispensing cycle.

DESCRIPTION OF REFERENCE NUMERALS

1 Medicine (Tablet)
2 Packing paper sheet (Dispensing paper)
10, 110, 220 Tablet dispensing apparatus
11, 111 Medicine storage
12, 112 Medicine feeder storage unit
13, 113 Medicine feeder
14, 114 Medicine guide assembly
114A First divided guide member
114B Second divided guide member
114*a* Temporary pool
15, 115 Medicine collecting assembly
16, 116 Medicine entry port
17, 117 Packing device
18, 118 Controller
19, 119 Operation panel
20, 220 Manual medicine dispensing device
21, 221 Preliminary dispenser
(Manual medicine dispensing device)
22, 222 Conveyor portion
(Manual medicine dispensing device)
41, 241 Air cleaning device
42 Air supply chamber
43A Flow path for cleaned air
43B Branch flow path for cleaned air
44A, 44B Cleaned air
45, 46, 47 Air pollution sensor

The invention claimed is:

1. A medicine dispensing apparatus comprising:

a housing;

a plurality of medicine feeder storage units juxtaposed inside the housing such that each unit can be drawn out from the housing, each unit including a plurality of medicine feeders operable to contain medicines and sequentially eject medicines and a medicine feeder casing configured to store the plurality of medicine feeders;

one or more medicine guide assemblies each disposed between paired adjacent medicine feeder storage units among the plurality of medicine feeder storage units, and each configured to guide the medicines, which have been ejected from the medicine feeders included in the paired medicine feeder storage units, to an outlet port located downward;

a medicine collecting assembly disposed downward of the plurality of medicine feeder storage units and configured to collect the medicines ejected from the one or more medicine guide assemblies;

a packing device disposed downward of the medicine collecting assembly and located in a lower space inside the housing, and operable to separately pack the collected medicines ejected from the medicine collecting assembly;

an air cleaning device operable to take in air from outside of the housing, clean the air, and supply the cleaned air to an interior of the housing to provide a positive pressure environment inside the housing;

an air supply chamber provided below the air cleaning device and operable to temporarily pool cleaned air discharged from the air cleaning device;

a flow path for cleaned air that delivers at least a part of the cleaned air into the medicine guide assemblies such that the cleaned air flows downward inside the medicine guide assemblies; and a branch flow path for cleaned air configured to branch the cleaned air supplied from the air cleaning device and delivers the branched cleaned air directly to the packing device such that the branched cleaned air does not pass through the flow path for cleaned air and the medicine collecting assembly, wherein:

the medicine guide assemblies each include a first divided guide member and a second divided guide member which are combined with each other when the paired medicine feeder storage units are accommodated in the housing and which are separated from each other when one of the paired medicine feeder storage units is drawn out from the housing;

the first divided guide member is fixed to the medicine feeder casing of one of the paired medicine feeder storage units and the second divided guide member is fixed to the medicine feeder casing of the other medicine feeder storage unit;

the air cleaning device is located upward of the plurality of medicine feeder storage units;

internal spaces of the respective medicine guide assemblies communicate with the air supply chamber and form the flow path for cleaned air such that the cleaned air, which has been supplied from the air supply chamber into the internal spaces, flows downward along a medicine falling path; and one or more air supply pipes each formed of a upright duct are disposed in a rear portion of the housing so as to communicate the air supply chamber with the lower space inside the housing, and the one or more air supply pipes form the branch flow path for cleaned air.

2. A medicine dispensing apparatus according to claim 1, wherein:

the medicine feeder storage units are drawn out from the housing in a draw-out direction;

the first divided guide member is shaped like a plate, having formed a plurality of through holes therein such that the medicines ejected from the medicine feeders included in the one medicine feeder storage unit pass through the through holes of the first divided guide member;

the second divided guide member includes:

a plate portion having formed a plurality of through holes therein such that the medicines ejected from the medicine feeders included in the other medicine feeder storage unit pass through the through holes of the plate portion, the plate portion having a first edge portion located on a first side of the plate portion and a second edge portion located on a second side of the plate portion, opposite to the first edge portion, said first and second edge portions extending transverse to the draw-out direction;

a first side wall portion extending away from the first edge portion of the plate portion; and a second side wall portion extending away from the second edge portion of the plate portion.

3. The medicine dispensing apparatus according to claim 1, wherein the first and second divided guide members are symmetrically shaped with respect to a parting plane thereof.

4. A medicine dispensing apparatus comprising:

a housing;

a plurality of medicine feeder storage units juxtaposed inside the housing, each unit including a plurality of medicine feeders operable to contain medicines and sequentially eject medicines and a medicine feeder casing configured to store the plurality of medicine feeders;

one or more medicine guide assemblies each configured to guide the medicines, which have been ejected from the medicine feeders included in the plurality of medicine feeder storage units, to an outlet port located downward;

a medicine collecting assembly disposed downward of the plurality of medicine feeder storage units and configured to collect the medicines ejected from the one or more medicine guide assemblies;

a packing device disposed downward of the medicine collecting assembly and located in a lower space inside the housing, and operable to separately pack the collected medicines ejected from the medicine collecting assembly;

an air cleaning device operable to take in air from outside of the housing, clean the air, and supply the cleaned air to an interior of the housing to provide a positive pressure environment inside the housing;

an air supply chamber provided below the air cleaning device and operable to temporarily pool cleaned air discharged from the air cleaning device;

a flow path for cleaned air that delivers at least a part of the cleaned air into the medicine guide assemblies such that the cleaned air flows downward inside the medicine guide assemblies; and a branch flow path for cleaned air that branches the cleaned air supplied from the air cleaning device and delivers the branched cleaned air directly to the packing device such that the branched cleaned air does not pass through the flow path for cleaned air and the medicine collecting assembly;

wherein:

the air cleaning device is located upward of the plurality of medicine feeder storage units;

internal spaces of the respective medicine guide assemblies communicate with the air supply chamber and form the flow path for cleaned air such that the cleaned air, which has been supplied from the air supply chamber into the internal spaces, flows downward along a medicine falling path; and one or more air supply pipes each formed of a upright duct are disposed in a rear portion of the housing so as to communicate the air supply chamber with the lower space inside the housing, and the one or more air supply pipes form the branch flow path for cleaned air.

5. The medicine dispensing apparatus according to claim 1, wherein one or more air pollution sensors operable to sense pollution of the cleaned air are disposed inside the housing.

6. The medicine dispensing apparatus according to claim 5, wherein the one or more air pollution sensors are disposed in at least one location selected from inside or outside of the flow path for cleaned air, inside or at an outlet port of the branch flow path for cleaned air, inside or in the vicinity of the medicine collecting assembly, and inside or in the vicinity of the packing device.

7. The medicine dispensing apparatus according to claim 5, wherein the air cleaning device has a controller operable to vary the amount of air which the air cleaning device supplies, according to the level of pollution of the cleaned air sensed by the air pollution sensor.

8. The medicine dispensing apparatus according to claim 5, further comprising an alarm signal generator operable to generate an alarm signal when the pollution of the cleaned air sensed by the air pollution sensor reaches or exceeds a predetermined level.

9. The medicine dispensing apparatus according to claim 4, wherein one or more air pollution sensors operable to sense pollution of the cleaned air are disposed inside the housing.

10. The medicine dispensing apparatus according to claim 9, wherein the one or more air pollution sensors are disposed in at least one location selected from inside or outside of the flow path for cleaned air, inside or at an outlet port of the branch flow path for cleaned air, inside or in the vicinity of the medicine collecting assembly, and inside or in the vicinity of the packing device.

11. The medicine dispensing apparatus according to claim 6, wherein the air cleaning device has a controller operable to vary the amount of air which the air cleaning device supplies, according to the level of pollution of the cleaned air sensed by the air pollution sensor.

12. The medicine dispensing apparatus according to claim 6, further comprising an alarm signal generator operable to generate an alarm signal when the pollution of the cleaned air sensed by the air pollution sensor reaches or exceeds a predetermined level.

13. The medicine dispensing apparatus according to claim 9, wherein the air cleaning device has a controller operable to vary the amount of air which the air cleaning device supplies, according to the level of pollution of the cleaned air sensed by the air pollution sensor.

14. The medicine dispensing apparatus according to claim 9, further comprising an alarm signal generator operable to generate an alarm signal when the pollution of the cleaned air sensed by the air pollution sensor reaches or exceeds a predetermined level.

15. The medicine dispensing apparatus according to claim 10, wherein the air cleaning device has a controller operable to vary the amount of air which the air cleaning device supplies, according to the level of pollution of the cleaned air sensed by the air pollution sensor.

16. The medicine dispensing apparatus according to claim 10, further comprising an alarm signal generator operable to generate an alarm signal when the pollution of the cleaned air sensed by the air pollution sensor reaches or exceeds a predetermined level.

* * * * *